US010337731B2

(12) United States Patent
Fang et al.

(10) Patent No.: US 10,337,731 B2
(45) Date of Patent: Jul. 2, 2019

(54) BOTTOM CUP COVER, BURNER AND GAS APPLIANCE

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Songqing Fang, Foshan (CN); Cheng Wang, Foshan (CN); Dingyan Li, Foshan (CN); Wen Li, Foshan (CN); Xiaodong Mi, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 159 days.

(21) Appl. No.: 15/701,092

(22) Filed: Sep. 11, 2017

(65) Prior Publication Data

US 2017/0370576 A1 Dec. 28, 2017

Related U.S. Application Data

(63) Continuation of application No. PCT/CN2015/082057, filed on Jun. 23, 2015.

(30) Foreign Application Priority Data

Mar. 12, 2015 (CN) ..... 2015 1 0110186

(51) Int. Cl.
*F23D 14/62* (2006.01)
*F23D 14/64* (2006.01)
(Continued)

(52) U.S. Cl.
CPC ..... *F23D 14/08* (2013.01); *F23D 14/065* (2013.01); *F23D 14/58* (2013.01); *F23D 14/62* (2013.01);
(Continued)

(58) Field of Classification Search
CPC ..... F23D 14/62; F23D 14/64; F23D 14/06; F23D 14/58
(Continued)

(56) References Cited

U.S. PATENT DOCUMENTS 8,464,703 B2 * 6/2013 Ryu ..... F23D 14/06 126/39 E
8,747,108 B2 * 6/2014 Lona Santoyo ..... F23D 14/06 126/39 B
(Continued)

FOREIGN PATENT DOCUMENTS

CN 1313483 A 9/2001
CN 2639722 Y 9/2004
(Continued)

OTHER PUBLICATIONS

Guangdong Midea Kitchen Appliances Manufacturing Co., Ltd. et al., Extended European Search Report, EP15884325.0, dated Feb. 8, 2018, 17 pgs.
(Continued)

*Primary Examiner* — Gregory L Huson
*Assistant Examiner* — Nikhil P Mashruwala
(74) *Attorney, Agent, or Firm* — Morgan, Lewis & Bockius LLP

(57) ABSTRACT

A bottom cup cover, a burner and a gas appliance are provided. The bottom cup cover includes a gas intake assembly defining a first gas intake channel, a second gas intake channel, and a connecting channel connecting the first gas intake channel to the second gas intake channel. The second gas intake channel is obliquely arranged relative to the first gas intake channel. The first gas intake channel has a gas inlet. The bottom cup cover defines a first primary air supplement cavity and a second primary air supplement cavity separated from the first primary air supplement cavity.
(Continued)

The first gas intake channel is in communication with the first primary air supplement cavity, the second gas intake channel is in communication with the second primary air supplement cavity, and the connecting channel is configured to enable a gas flow to circulate between the first and second primary air supplement cavities.

10 Claims, 13 Drawing Sheets

(51) Int. Cl.

| | |
|---|---|
| ***F23D 14/58*** | (2006.01) |
| ***F23D 14/06*** | (2006.01) |
| ***F24C 3/08*** | (2006.01) |
| ***F23D 14/08*** | (2006.01) |

(52) U.S. Cl.
CPC ..... *F23D 14/64* (2013.01); *F24C 3/08* (2013.01); *F23D 2900/14* (2013.01); *F23D 2900/14062* (2013.01)

(58) Field of Classification Search
USPC ..... 126/39 E, 39 R; 431/354
See application file for complete search history.

(56) References Cited

U.S. PATENT DOCUMENTS

| | | | | |
|---|---|---|---|---|
| 9,127,838 | B2 * | 9/2015 | Paesani | F23D 14/065 |
| 2006/0292506 | A1 * | 12/2006 | Pozzan | F23D 14/08 431/160 |
| 2014/0209088 | A1 * | 7/2014 | Bettinzoli | F23D 14/06 126/39 E |
| 2018/0106476 | A1 * | 4/2018 | Breccia | F24C 3/082 |
| 2018/0135851 | A1 * | 5/2018 | Biagioli | F23D 14/04 |

FOREIGN PATENT DOCUMENTS

| | | | |
|---|---|---|---|
| CN | 101514814 | A | 8/2009 |
| CN | 101636618 | A | 1/2010 |
| CN | 201526969 | U | 7/2010 |
| CN | 102661606 | A | 9/2012 |
| CN | 104713087 | A | 6/2015 |
| EP | 0732541 | A2 | 9/1996 |
| WO | WO 2008/116773 | A2 | 10/2008 |

OTHER PUBLICATIONS

Guangdong Midea, International Search Report and Written Opinion, PCT/CN2015082057, dated Dec. 21, 2015, 21 pgs.
Midea, First Office Action, PCT/CN 201510110186-0, dated Aug. 18, 2016, 20 pgs.

* cited by examiner

BOTTOM CUP COVER, BURNER AND GAS APPLIANCE

RELATED APPLICATIONS

This application is a continuation application of PCT/CN2015/082057, entitled "BOTTOM CUP COVER, BURNER AND GAS APPLIANCE" filed on Jun. 23, 2015, which claims priority to Chinese Patent Application No. 201510110186.0, filed with the State Intellectual Property Office of the People's Republic of China on Mar. 12, 2015, and entitled "BOTTOM CUP COVER, BURNER AND GAS APPLIANCE", both of which are incorporated herein by reference in their entirety.

FIELD

The present disclosure relates to a field of kitchen appliances, more specifically to a bottom cup cover, a burner including the bottom cup cover, and a gas appliance including the burner.

BACKGROUND

In an existing gas appliance, a burner generally includes a bottom cup and a flame spray, and the flame spray is arranged on the bottom cup. The bottom cup defines a gas intake, and gas is sprayed towards an interior of the bottom cup through a nozzle after passing through the gas intake. The gas intake of the burner at present is fixed and unchangeable, cannot meet use requirements of different consumers, and is not high in universalization and standardization degree. Meanwhile, a design object of the burner pursued continuously by a global burner industry is to improve a thermal efficiency of the burner, optimize a design to improve a manufacturability of the burner, thereby facilitating processing and improving production and assembly efficiency of the burner.

SUMMARY

Embodiments of the present disclosure seek to solve at least one of the problems existing in the related art. Thus, the present disclosure provides a bottom cup cover, a burner including the bottom cup cover, and a gas appliance including the burner.

A bottom cup cover includes a gas intake assembly provided with a first gas intake channel, a connecting channel and a second gas intake channel, the connecting channel connects the first gas intake channel and the second gas intake channel, the second gas intake channel is obliquely arranged relative to the first gas intake channel, and the first gas intake channel has a gas inlet. A first primary air supplement cavity and a second primary air supplement cavity are defined in the bottom cup cover, the first primary air supplement cavity is separated from the second primary air supplement cavity, the first gas intake channel is in communication with the first primary air supplement cavity, the second gas intake channel is in communication with the second primary air supplement cavity, and the connecting channel is configured to gas flow to circulate between the first primary air supplement cavity and the second primary air supplement cavity.

With the bottom cup cover above, a gas can be introduced through the gas inlet of the first gas intake channel, a part thereof arrives in the first primary air supplement cavity, and the other part thereof arrives in the second primary air supplement cavity after being diverted to the second gas intake channel through the connecting channel. When fire power of one of the rings of flame is required to be controlled separately, for example, while keeping an outer ring fire power constant, an inner ring fire power is required to be adjusted separately, in which case one gas source is required to be separately supplied to the inner ring, the connecting channel is not processed, and a gas inlet of the second gas intake channel can be in communication with the gas source. Thus, the bottom cup cover above not only can be adapted to a gas supply with a single gas source, but also can be adapted to a gas supply with two gas sources so as to meet use requirements of different consumers, and improve the universalization and standardization degree of the product. Meanwhile, the bottom cup cover above can be conveniently processed, and the production and assembly efficiency of the burner can be improved.

In an embodiment, the bottom cup cover includes a first supplement part, a first mixing part and a second supplement part, the gas intake assembly includes a first gas intake part, a second gas intake part and a connecting part, the connecting part connects the first gas intake part and the second gas intake part. The first gas intake part, the first supplement part and the first mixing part are connected sequentially, the second supplement part is connected to the first mixing part from above, the second gas intake part penetrates the first supplement part and the second supplement part, and the connecting part is arranged at an outer side wall of the first supplement part. The first supplement part defines the first primary air supplement cavity, the second supplement part defines the second primary air supplement cavity, the first mixing part defines a first groove in communication with the first primary air supplement cavity, the first groove penetrates the first mixing part in an axial direction of the first gas intake channel, the first gas intake part defines the first gas intake channel, the second gas intake part defines the second gas intake channel, and the connecting part defines the connecting channel.

In an embodiment, the bottom cup cover further includes a rib arranged at a circumferential edge of the second primary air supplement cavity, and the rib is provided with a waterproof chamfer.

In an embodiment, the bottom cup cover further includes a first surface and a first positioning member arranged on the first surface, wherein the first positioning member is connected to an outer circumferential edge of the rib.

In an embodiment, the first positioning member includes a plurality of stepped structures arranged on the first surface, the plurality of stepped structures are connected to the outer circumferential edge of the rib in a spaced arrangement, each stepped structure comprises a first top surface, and a second top surface and the first top surface is more adjacent to the second primary air supplement cavity than the second top surface.

A burner includes a bottom cup assembly and a flame spray arranged on the bottom cup assembly, in which the bottom cup assembly includes a bottom cup cover according to claim 1 and a bottom cup seat, the bottom cup cover is fitted in the bottom cup seat, and the flame spray is arranged on the bottom cup cover.

In an embodiment, the bottom cup cover includes a first supplement part, a first mixing part and a second supplement part, the gas intake assembly includes a first gas intake part, a second gas intake part and a connecting part, the connecting part connects the first gas intake part and the second gas intake part. The first gas intake part, the first supplement part and the first mixing part are connected sequentially, the second supplement part is connected to the first mixing part from above, the second gas intake part penetrates the first supplement part and the second supplement part, and the connecting part is arranged to an outer side wall of the first supplement part. The first supplement part defines a first primary air supplement cavity, the second supplement part defines a second primary air supplement cavity, the first mixing part defines a first groove in communication with the first primary air supplement cavity, the first groove penetrates the first mixing part in an axial direction of the first gas intake channel, the gas intake part defines the first gas intake channel, the second gas intake part defines the second gas intake channel, and the connecting part defines the connecting channel.

In an embodiment, the bottom cup seat includes a first chamber part, a second mixing part and a second chamber part connected sequentially, the first chamber part is connected to the first supplement part and defines a first chamber, the first chamber and the first primary air supplement cavity form a first primary air supplement chamber together. The second mixing part is connected to the first mixing part, the second mixing part and the first mixing part form a horizontal Venturi tube together, the second mixing part defines a second groove, and the second groove and the first groove form a mixing channel of the horizontal Venturi tube together. The second chamber part defines a primary air/gas mixing and distributing chamber, and the primary air/gas mixing and distributing chamber is in communication with the first primary air supplement chamber through the mixing channel.

In an embodiment, the burner further includes an inner flame cover and an outer flame cover, the flame spray includes an outer ring flame spray, an inner ring flame spray and a vertical Venturi tube. The inner ring flame spray is located inside the outer ring flame spray, the vertical Venturi tube is located inside the inner ring flame spray, the inner flame cover covers the inner ring flame spray, the inner flame cover, the inner ring flame spray and the vertical Venturi tube define an inner mixed gas arrival chamber together, and the vertical Venturi tube communicates the inner mixed gas arrival chamber with the second primary air supplement cavity. The outer flame cover covers the outer ring flame spray, the outer flame cover and the outer ring flame spray define an outer mixed gas arrival chamber together, and the outer mixed gas arrival chamber is in communication with the primary air/gas mixing and distributing chamber.

A gas appliance includes the burner above.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

DETAILED DESCRIPTION

Figure 1:
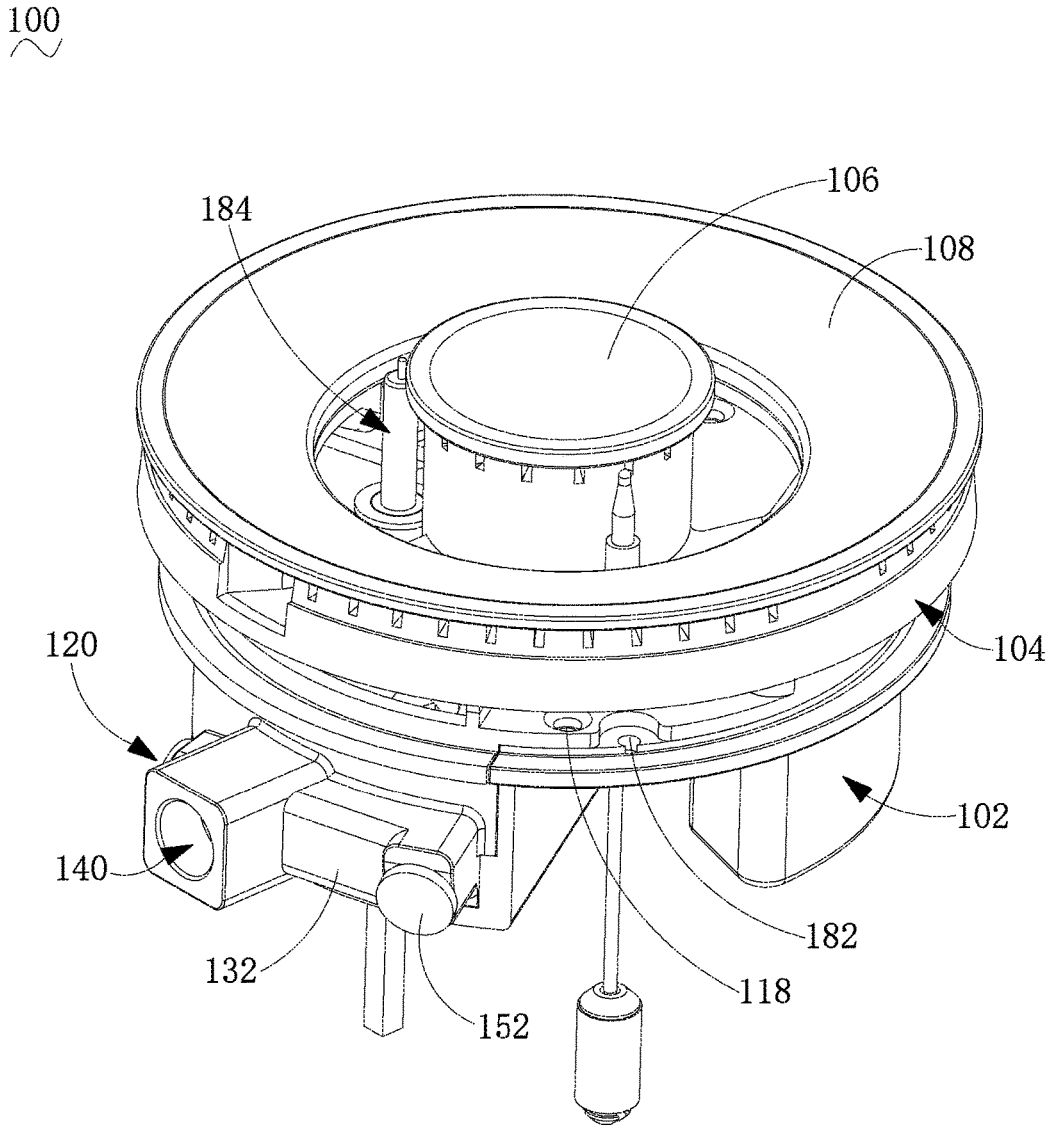
FIG. 1 illustrates a perspective view of a burner according to a preferred embodiment of the present disclosure.

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, illustrative, and used to generally understand the present disclosure. The embodiments shall not be construed to limit the present disclosure.

It should be noted that, terms such as "first" and "second" are used herein for purposes of description and are not intended to indicate or imply relative importance or significance or to imply the number of indicated technical features. Thus, features limited by "first" and "second" are intended to indicate or imply including one or more than one these features. In the description of the present disclosure, the term "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements. The above terms can be understood by those skilled in the art according to specific situations.

The following disclosure provides many different embodiments or examples to realize different structures of the present disclosure. To simplify the disclosure of the present disclosure, components and configurations in particular examples are elaborated. Of course, they are illustrative, and are not intended to limit the present disclosure.

Moreover, reference numbers and/or letters may be repeated in different examples of the present disclosure for the purpose of simplicity and clarity, which shall not be constructed to indicate the relationships among various embodiments and/or configurations. In addition, the present disclosure provides examples of various specific processes and materials, but applicability of other processes and/or utilization of other materials are conceivable for those skilled in the art.

Referring to FIGS. 1 to 6, a burner 100 according to preferred embodiments of the present disclosure includes a bottom cup assembly 102, a flame spray 104, an inner flame cover 106, an outer flame cover 108, a first nozzle 110 and a second nozzle 112.

Figure 3:
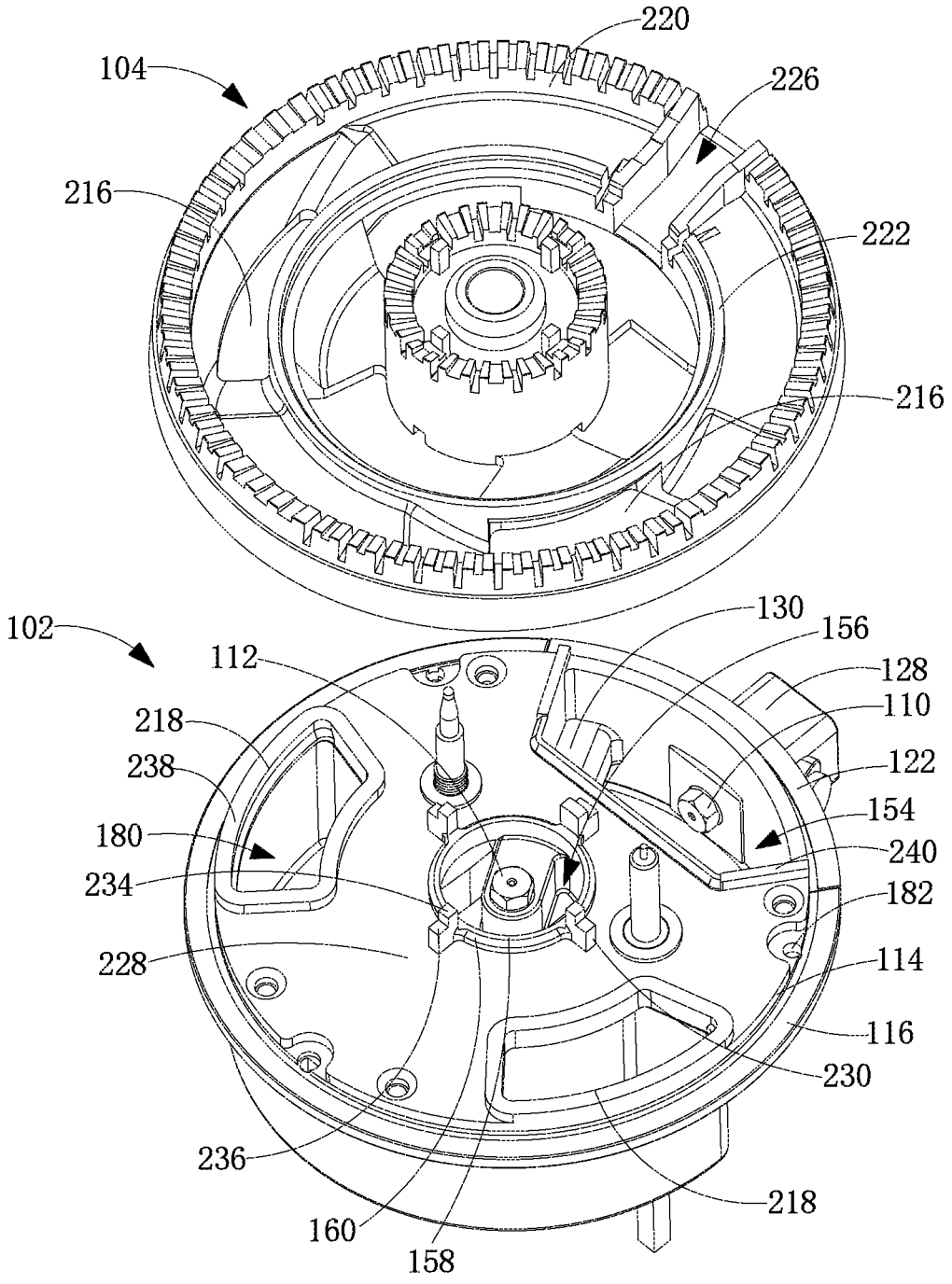
FIG. 3 illustrates an exploded view of a burner according to a preferred embodiment of the present disclosure, in which an inner flame cover and an outer flame cover are omitted.
Figure 4:
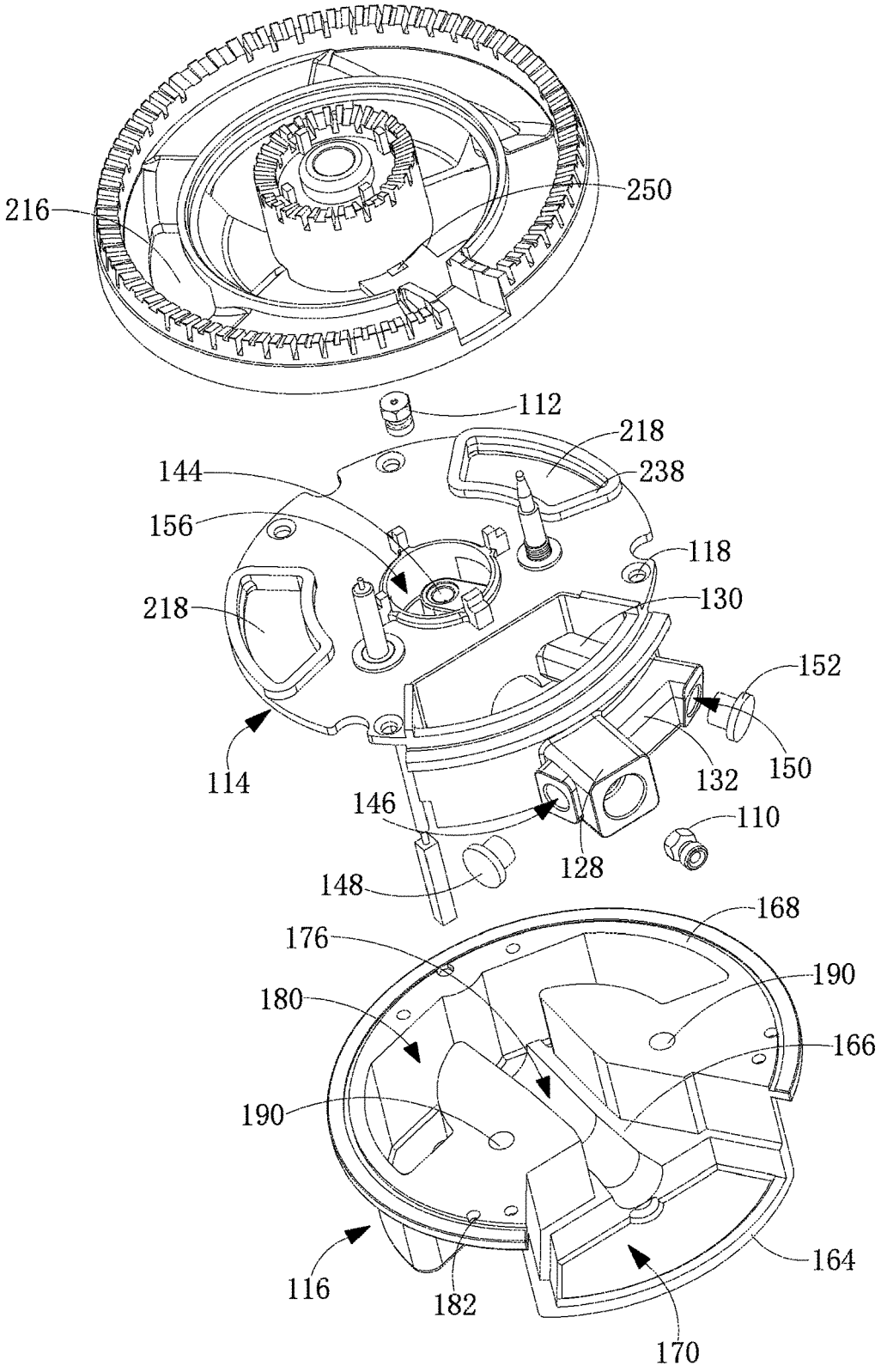
FIG. 4 illustrates another exploded view of a burner according to a preferred embodiment of the present disclosure, in which an inner flame cover and an outer flame cover are omitted.
Figure 5:
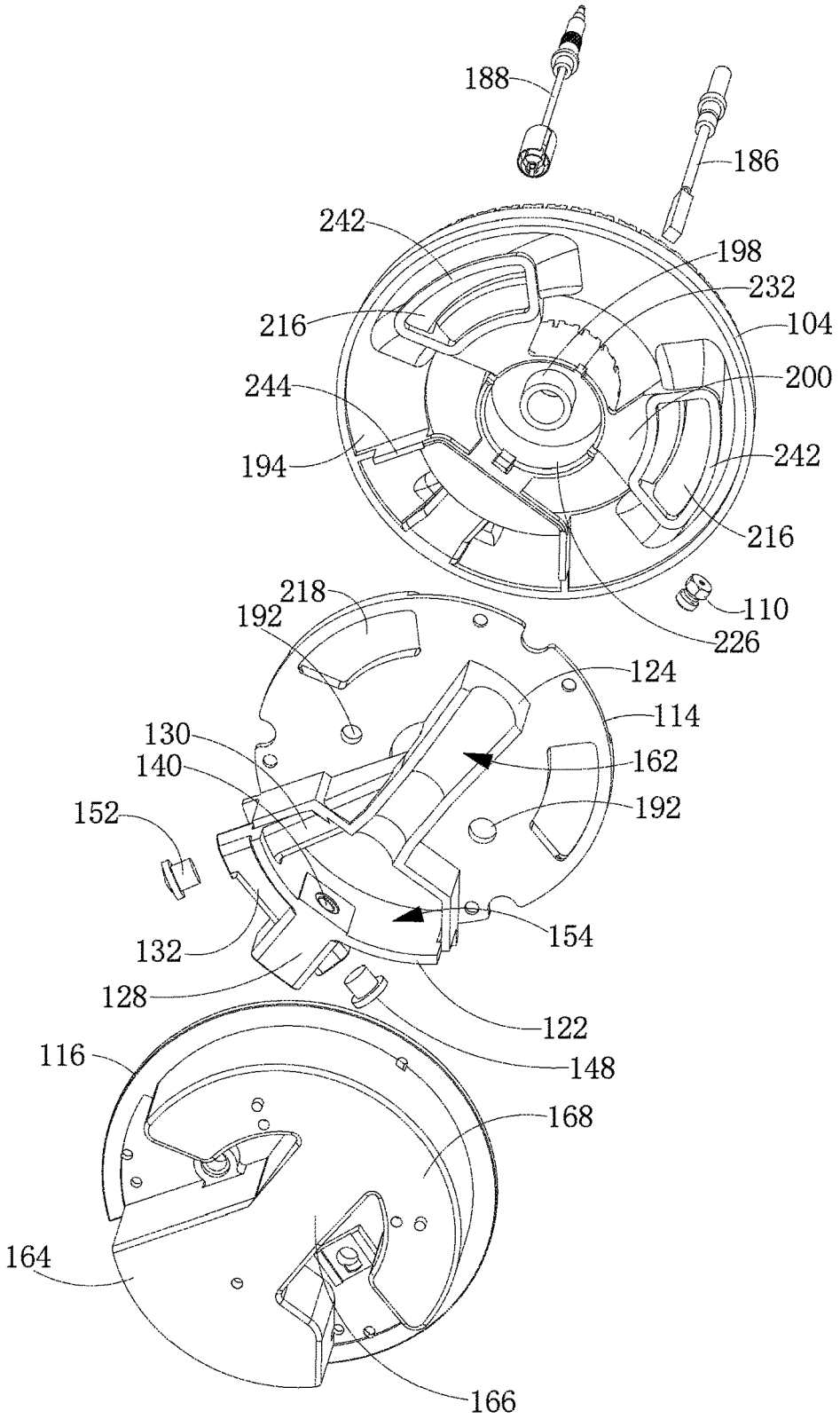
FIG. 5 illustrates still another exploded view of a burner according to a preferred embodiment of the present disclosure, in which an inner flame cover and an outer flame cover are omitted.
Figure 6:
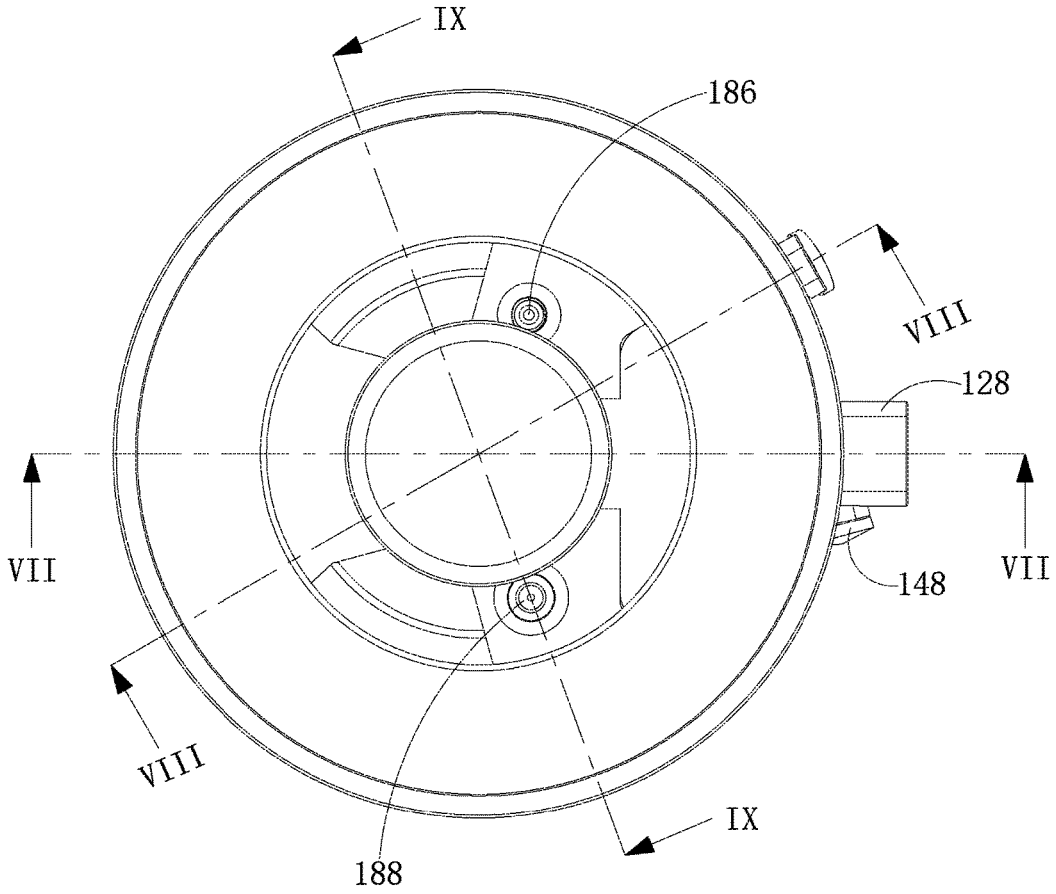
FIG. 6 illustrates a plan view of a burner according to a preferred embodiment of the present disclosure.

Referring to FIGS. 3 to 5, the bottom cup assembly 102 includes a bottom cup cover 114 and a bottom cup seat 116, the bottom cup cover 114 is fitted in the bottom cup seat 116, for example, the bottom cup cover 114 is connected to the bottom cup seat 116 through a riveting hole 118. Specifically, referring to FIGS. 5 and 8, the bottom cup cover 114 includes a gas intake assembly 120, a first supplement part 122, a first mixing part 124 and a second supplement part 126.

The gas intake assembly 120 includes a first gas intake part 128, a second gas intake part 130 and a connecting part 132, and the connecting part 132 connects the first gas intake part 128 and the second gas intake part 130. The first gas intake part 128, the first supplement part 122 and the first mixing part 124 are connected sequentially. The second supplement part 126 is connected to the first mixing part from above 124, the second gas intake part 130 penetrates the first supplement part 122 and the second supplement part 126, and the connecting part 132 is arranged at an outer side wall of the first supplement part 122.

Figure 7:
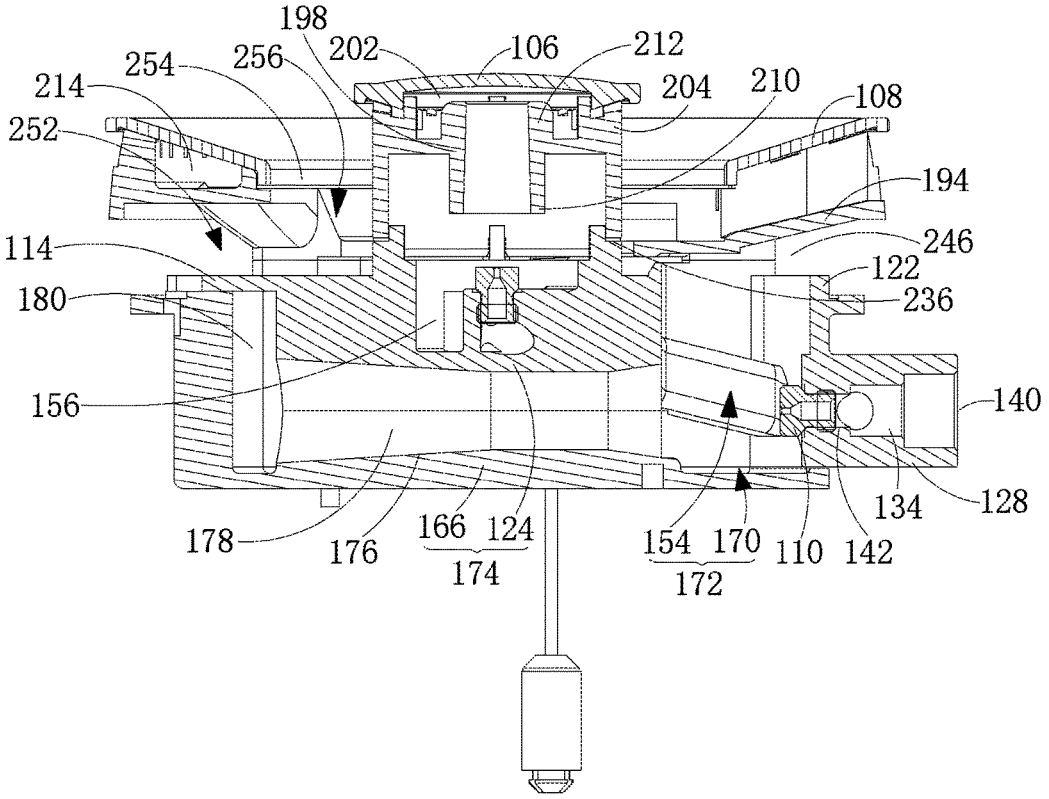
FIG. 7 illustrates a sectional view of the burner of FIG. 6 taken along line VII-VII.
Figure 8:
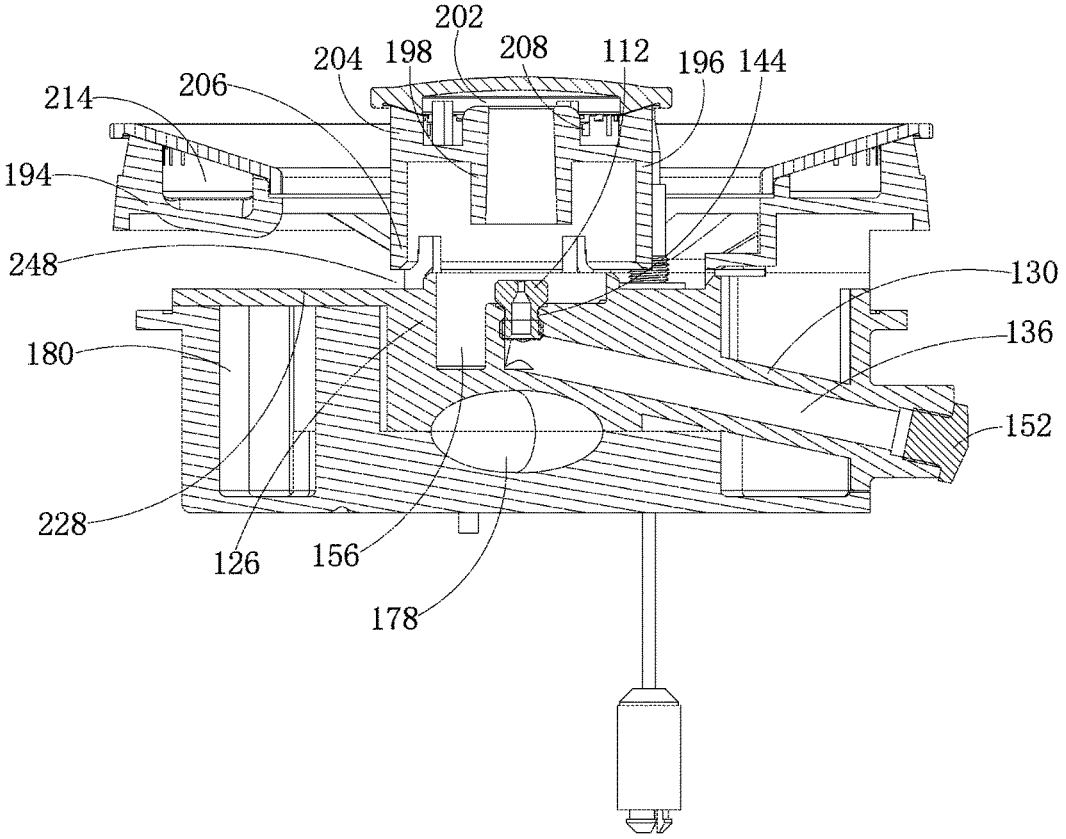
FIG. 8 illustrates a sectional view of the burner of FIG. 6 taken along line VIII-VIII.

Referring to FIG. 7, the first gas intake part 128 is a tubular gas intake part substantially placed horizontally. Referring to FIG. 8, the second gas intake part 130 is a tubular gas intake part placed obliquely. The obliquely placed second gas intake part 130 has a structure through which gas flows smoothly, and the structure is easy in demolding and easy to machine, thereby improving the manufacturability of the burner 100, and reducing the costs.

Figure 11:
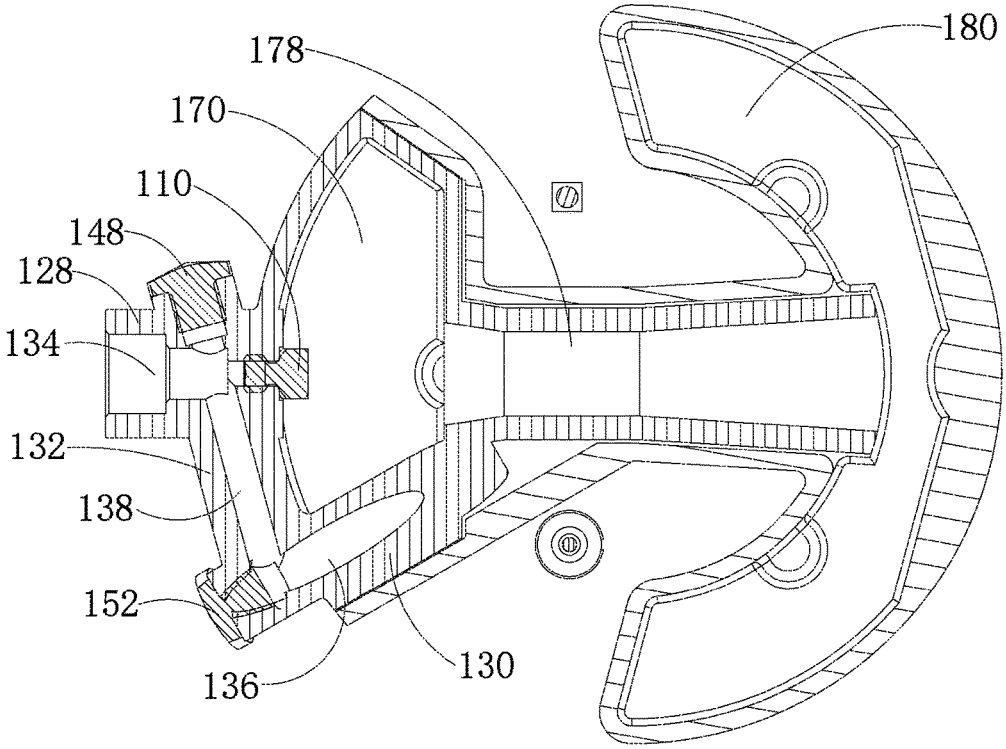
FIG. 11 illustrates a sectional view of the burner of FIG. 10 taken along line XI-XI.

Referring to FIG. 7, the first gas intake part 128 defines a first gas intake channel 134. Referring to FIG. 8, the second gas intake part 130 defines a second gas intake channel 136. Referring to FIG. 11, the connecting part 132 defines a connecting channel 138. The second gas intake channel 136 is arranged obliquely relative to the first gas intake channel 134.

The connecting channel 138 connects the first gas intake channel 134 and the second gas intake channel 136, such that the gas flow can circulate between the first gas intake channel 134 and the second gas intake channel 136. Therefore, the connecting channel 138 transversely connects the first gas intake channel 134 and the second gas intake channel 136.

Referring to FIG. 7, the first gas intake channel 134 has a gas inlet 140 and a gas outlet 142. The gas inlet 140 of the first gas intake channel 134 can be connected to an external gas source. The first nozzle 110 is arranged in the gas outlet 142 of the first gas intake channel 134. The second gas intake channel 136 has a gas outlet 144 (see FIGS. 4 and 8), the gas outlet 144 of the second gas intake channel 136 is defined in an end of the second gas intake part 130 away from the connecting part 132, and the second nozzle 112 is arranged in the gas outlet 144 of the second gas intake channel 136. Thus, when the gas flows into the first gas intake channel 134, a part of the gas is sprayed to the first supplement part 122 through the first nozzle 110, and the other part of the gas is sprayed to the second supplement part 126 through the second nozzle 112.

Referring to FIGS. 8 and 11, in the present embodiment, a first auxiliary hole 146 (see FIG. 4) is defined in an outer wall of the first gas intake part 128 away from the connecting part 132. The first auxiliary hole 146 penetrates through the first gas intake channel 134, and is in communication with the connecting channel 138, to ensure a process realizability of the connecting channel 138. The first auxiliary hole 146 is blocked by a first plug 148, thereby ensuring gas tightness of the burner 100. A second auxiliary hole 150 (see FIG. 4) is defined in the other end of the second gas intake part 130 connected to the connecting part 132 to ensure a process realizability of the second gas intake channel 136. The second auxiliary hole 150 is blocked by a second plug 152, thereby ensuring the gas tightness of the burner 100. Meanwhile, the second auxiliary hole 150 may also serve as a gas inlet of the second gas intake channel 136. For example, when the gas supply with two gas sources is needed, the connecting channel 138 is not processed, and the second plug 152 can be opened, such that a second gas source can be in communication with the second auxiliary hole 150. Because the connecting channel 138 is not processed, the first gas intake channel 134 is not in communication with the second gas intake channel 136, and further the gas can be supplied to the first gas intake channel 134 and the second gas intake channel 136 separately.

Referring to FIGS. 5 and 7, the first supplement part 122 is fan-shaped, and the second gas intake part 130 penetrates an inner side edge of the first supplement part 122. The first supplement part 122 defines a first primary air supplement cavity 154. The first primary air supplement cavity 154 penetrates the first supplement part 122. The first primary air supplement cavity 154 is in communication with the first gas intake channel 134 through the first nozzle 110. The first gas intake part 128 is connected to a relatively large end of the first supplement part 122, and the first mixing part 124 is connected to a relatively small end of the first supplement part 122. The current flows from the relatively large end of the first supplement part 122 to the relatively small end of the first supplement part 122, thereby facilitating spraying of the gas flow.

The second supplement part 126 defines a second primary air supplement cavity 156. The first primary air supplement cavity 154 is separated from the second primary air supplement cavity 156. The second nozzle 112 and the end of the second gas intake part 130 away from the connecting part 132 are located in the second primary air supplement cavity 156. The second primary air supplement cavity 156 is in communication with the second gas intake channel 136 through the second nozzle 112.

The bottom cup cover 114 further includes a rib 158 arranged at a circumferential edge of the second primary air supplement cavity 156, and the rib 158 is provided with a waterproof chamfer 160. Such that a liquid, such as water, soup and the like, can effectively be prevented from entering the bottom cup cover 114 of the burner 100 to block the nozzles 110, 112.

The first mixing part 124 defines a first groove 162 (see FIG. 5) in communication with the first primary air supplement cavity 154, and the first groove 162 is separated from the second primary air supplement cavity 156. In the present embodiment, the first groove 162 is provided horizontally and penetrates through the first mixing part 124 in an axial direction of the first gas intake part 128. Therefore, the first nozzle 110 is in direct communication with first groove 162, a rear end of the first groove 162 (an end of the first groove 162 away from the first nozzle 110) is uncovered, thereby facilitating processing of the bottom cup cover 114 and making of molds, improving the manufacturability of the burner 110 and reducing the costs.

The bottom cup seat 116 includes a first chamber part 164, a second mixing part 166 and a second chamber part 168 which are connected sequentially. The first chamber part 164 is connected to the first supplement part 122 and defines a first chamber 170, and the first chamber 170 and the first primary air supplement cavity 154 together form a first primary air supplement chamber 172. In the present embodiment, the first chamber part 164 is fan-shaped and matches with the first supplement part 122.

The second mixing part 166 is connected to the first mixing part 124 and forms a horizontal Venturi tube 174 (see FIG. 7) together. The second mixing part 166 defines a second groove 176, and the second groove 176 and the first groove 162 together form a mixing channel 178 of the horizontal Venturi tube 174.

Figure 10:
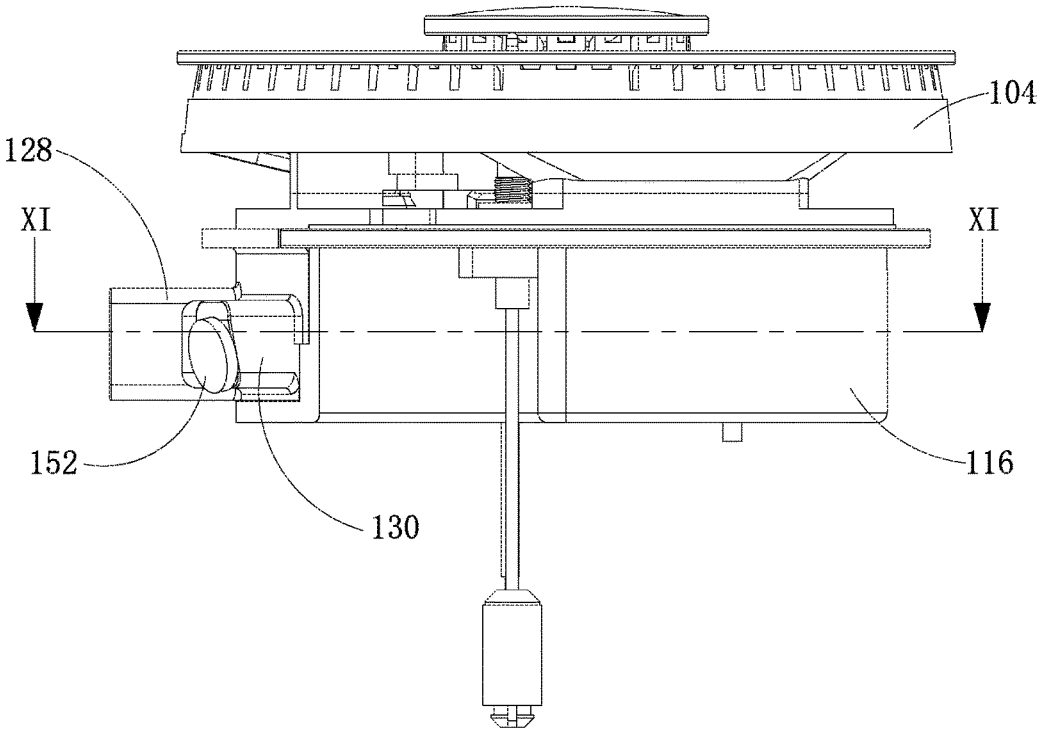
FIG. 10 illustrates a side view of a burner according to a preferred embodiment of the present disclosure.

The second chamber part 168 defines a primary air/gas mixing and distributing chamber 180, and the primary air/gas mixing and distributing chamber 180 is in communication with the first primary air supplement chamber 172 through the mixing channel 178. In the present embodiment, the second chamber part 168 is fan-shaped, and an arc length of the second chamber part 168 is greater than an arc length of the first chamber part 164. Referring to FIGS. 10 and 11, the primary air/gas mixing and distributing chamber 180 has two chambers bent from a periphery of the burner 100 to two sides of a center of the burner 100. Therefore, the first chamber part 164 facilitates mixing of the gas, while the second chamber part 168 facilitates the distributing of the gas.

Referring to FIGS. 1 and 4, a first mounting hole 182 is defined in the bottom cup seat 116, and the first mounting hole 182, is separated from the first chamber 170, the second groove 176 and the primary air/gas mixing and distributing chamber 180. In the process of mounting the burner 100 to a gas appliance, a fastener can fix the bottom cup assembly 102 to the gas appliance through the first mounting hole 182.

The bottom cup assembly 102 is further provided with an ignition device 184. Specifically, the ignition device 184 includes an ignition pin 186 and a thermocouple 188, two first via holes 190 through which the ignition pin 186 and the thermocouple 188 pass are defined in the bottom cup seat 116, and two second via holes 192 corresponding to the two first via holes 190 respectively are defined in the bottom cup cover 114. The two first via holes 190 are located at two sides of the second mixing part 166 respectively. The two second via holes 192 are located at two sides of the first mixing part 124 respectively. The thermocouple 188 passes through the first via hole 190 and the second via hole 192 sequentially, and the ignition pin 186 passes through the first via hole 190 and the second via hole 192 sequentially.

Figure 2:
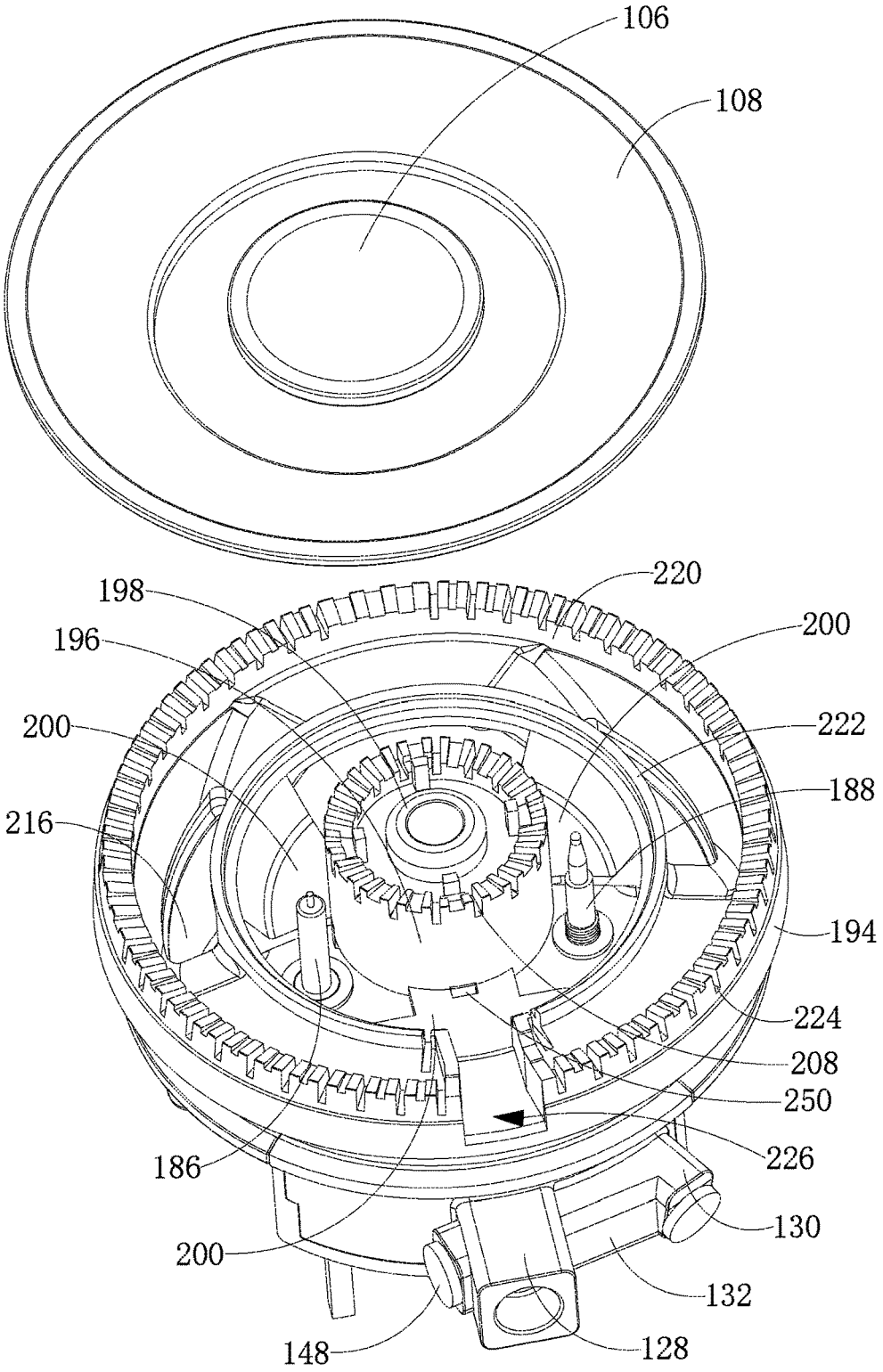
FIG. 2 illustrates an exploded view of a burner according to a preferred embodiment of the present disclosure.

Referring to FIG. 2, the flame spray 104 is arranged on the bottom cup cover 114 of the bottom cup assembly 102. The flame spray 104 includes an outer ring flame spray 194, an inner ring flame spray 196, a vertical Venturi tube 198 and a connecting rib 200.

Referring to FIG. 7, the inner ring flame spray 196 is located inside of the outer ring flame spray 194, and the vertical Venturi tube 198 is located inside the inner ring flame spray 196. The inner flame cover 106 covers the inner ring flame spray 196, the inner flame cover 106, the inner ring flame spray 196 and the vertical Venturi tube 198 define an inner mixed gas arrival chamber 202 together. The vertical Venturi tube 198 communicates the inner mixed gas arrival chamber 202 with the second primary air supplement cavity 156. Since the first primary air supplement cavity 154 is separated from the second primary air supplement cavity 156, the vertical Venturi tube 198 and the horizontal Venturi tube 174 can operate separately, avoiding mutual influence.

Specifically, Referring to FIG. 8, the inner ring flame spray 196 includes a first end 204 and a second end 206 connected to the first end 204. The inner flame cover 106 covers on the first end 204. Inner-ring flame holes 208 are defined in the inner ring flame spray 196 in a circumferential edge of the first end 204 of the inner ring flame spray 196. The inner-ring flame holes 208 are in communication with the inner mixed gas arrival chamber 202, the air and the gas are mixed in the vertical Venturi tube 198, after mixing, the gas mixture enters the inner mixed gas arrival chamber 202, and is sprayed out through the inner-ring flame holes 208 to form an inner-ring flame.

Referring to FIG. 7, the vertical Venturi tube 198 includes a gas inlet end 210 and gas outlet end 212. The gas inlet end 210 faces the second primary air supplement cavity 156, and the gas outlet end 212 is located in the first end 204 of the inner ring flame spray 196. The inner flame cover 106, the first end 204 of the inner ring flame spray 196 and the gas outlet end 212 define the inner mixed gas arrival chamber 202 together.

Figure 9:
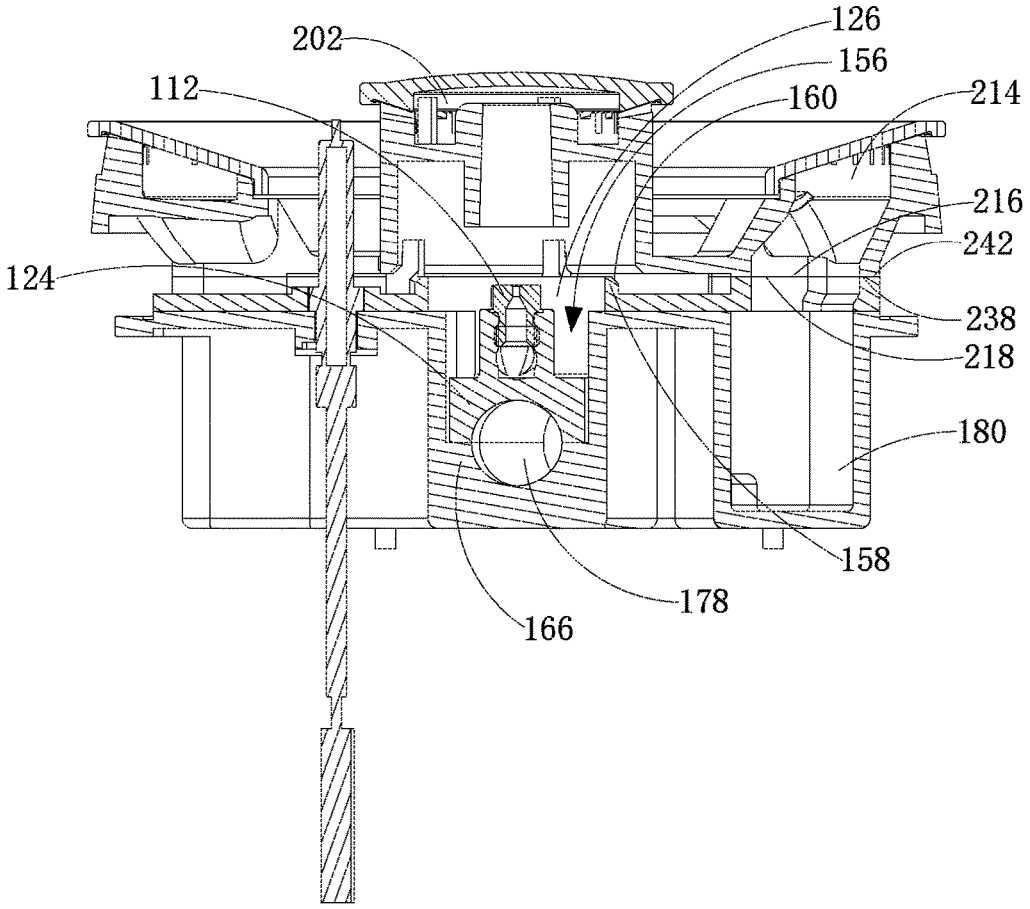
FIG. 9 illustrates a sectional view of the burner of FIG. 6 taken along line IV-IV.

Referring to FIGS. 7 and 9, the outer ring flame spray 194 is arranged at the outside of the inner ring flame spray 196. The outer flame cover 108 covers the outer ring flame spray 194, the outer flame cover 108 and the outer ring flame spray 194 define an outer mixed gas arrival chamber 214 together, and the outer mixed gas arrival chamber 214 is in communication with the primary air/gas mixing and distributing chamber 180. Specifically, please referring to FIGS. 4 and 9, two outer-ring openings 216 spaced apart are defined in the outer ring flame spray 194. Correspondingly, two bottom cup cover openings 218 spaced apart are defined in the bottom cup cover 114. The outer-ring openings 216 are fitted with and in communication with the bottom cup cover openings 218, such that the primary air/gas mixing and distributing chamber 180 can be in communication with the outer mixed gas arrival chamber 214.

Referring to FIG. 2, the outer ring flame spray 194 includes an outer ring part 220 and a middle ring part 222 spaced apart, and the middle ring part 222 is located between the inner ring flame spray 196 and the outer ring part 220. The outer-ring openings 216 are defined between the outer ring part 220 and the middle ring part 222. Outer-ring flame holes 224 in communication with the outer mixed gas arrival chamber 214 are defined in the outer ring part 220 along a circumferential edge of the outer ring part 220, and middle-ring flame holes (not illustrated) in communication with the outer mixed gas arrival chamber 214 are defined in the middle ring part 222 along a circumferential edge of the middle ring part 222.

The gas mixture in the primary air/gas mixing and distributing chamber 180 enters the outer mixed gas arrival chamber 214 through the bottom cup cover opening 218 and the outer-ring opening 216, and then is sprayed out through the outer-ring flame holes 224 and the middle-ring flame holes to form an outer ring flame and a middle ring flame respectively. Therefore, the flame spray 104 of the present embodiment can provided three rings of flame, thereby achieving a multi-ring high efficiency burner 100 with the outer ring flame, the middle ring flame and the inner ring flame. It should be understood that when only two rings of flame are required for the burner 100, the burner 100 can be configured flexibly, for example, the middle ring part 222 may be provided with no flame hole.

Referring to FIG. 2, further, a fire guiding slot 226 may be defined in the outer ring flame spray 194, and the fire guiding slot 226 penetrates through the outer ring part 220 and the middle ring part 222. The fire guiding slot 226 and the two outer-ring openings 216 are distributed sequentially in a circumference of the outer ring flame spray 194. The fire guiding slot 226 is configured to guide the flame from the inner ring flame spray 196 to the outer ring flame spray 194.

The connecting rib 200 connects the inner ring flame spray 196 and the outer ring flame spray 194. In the present embodiment, the number of the connecting rib is three, three connecting ribs 200 connects the inner ring flame spray 196 and the outer ring flame spray 194 in a spaced arrangement. The ignition pin 186 and the thermocouple 188 pass through spaces between two adjacent connecting ribs 200 respectively, and an end of the ignition pin 186 and an end of the thermocouple 188 are adjacent to the inner-ring flame hole 208 to achieve an ignition. The connecting ribs 200 achieve an integrally formed structure of the flame spray 104, and further improve the assembly and production efficiency of the flame spray 104.

Additionally, as illustrated in FIG. 3, in order to assemble the flame spray 104 and the bottom cup assembly 102, the bottom cup cover 114 includes a first surface 228 facing the flame spray 104 and a first positioning member 230 arranged on the first surface 228. As illustrated in FIG. 5, an end surface of the second end 206 of the inner ring flame spray 196 is provided with a second positioning member 232, and the first positioning member 230 is fitted with the second positioning member 232 to position the flame spray 104 on the bottom cup cover 114.

Specifically, in the present embodiment, the first positioning member 230 includes four stepped structures arranged on the first surface 228, and the four stepped structures are connected to an outer circumferential edge of the rib 158 in a spaced arrangement. Each stepped structure include a first top surface 234 and a second top surface 236, and the first top surface 234 is more adjacent to the second primary air supplement cavity 156 than the second top surface 236.

The second positioning member 232 includes four positioning grooves defined in the end surface of the second end 206, and a distribution mode of the four positioning grooves corresponds to a distribution mode of the four stepped structures. In the process of mounting, for example, the flame spray 104 is placed on the bottom cup cover 114, then the flame spray 104 or the bottom cup cover 114 is turned, or the flame spray 104 and the bottom cup cover 114 are turned at the same time, to snap the stepped structures into the corresponding positioning grooves, a bottom surface of the positioning groove is aligned with the second top surfaces 236 of the stepped structures, and then a relative position of the flame spray 104 and the bottom cup cover 114 is determined, thereby limiting a rotational orientation of the flame spray 104.

Referring to FIG. 3, further, the bottom cup cover 114 is provided with a first bottom cup cover fitting surface 238 at a circumferential edge of the bottom cup cover opening 218, and two side ends of the first supplement part 122 are provided with second bottom cup cover fitting surfaces 240. Correspondingly, referring to FIG. 5, the flame spray 104 is provided with a first outer ring fitting surface 242 at a circumferential edge of the outer-ring opening 216, and the outer ring flame spray 194 is provided with second outer ring fitting surfaces 244 at a surface of the outer ring flame spray 194 opposing the bottom cup cover 114. When the flame spray 104 is well mounted to the bottom cup cover 114, the first bottom cup cover fitting surface 238 is fitted with the first outer ring fitting surface 242, the second bottom cup cover fitting surfaces 240 are fitted with the second outer ring fitting surfaces 244, such that a full positioning of the flame spray 104 and the bottom cup assembly 102 can be achieved together with an positioning structure composed of the stepped structure/positioning groove above. Additionally, a first primary air supplement channel 246 (see FIG. 7) is formed between the first supplement part 122 and the outer ring flame spray 194, and the first primary air supplement channel 246 is in communication with the first primary air supplement cavity 154. Additionally, a second primary air supplement channel 248 (see FIG. 8) is formed between the end surface of the second end 206 and the first surface 228, and the second primary air supplement channel 248 is in communication with the second primary air supplement cavity 156.

Referring to FIG. 2, the connecting ribs 200 may also define a visual observation window 250. The visual observation window 250 is in communication with one of the positioning grooves, such that the user can observe conveniently that whether the stepped structures are snapped into the positioning grooves through the visual observation window 250 to complete the assembling of the flame spray 104 on the bottom cup assembly 102.

Further, in order to supplement more air to the middle-ring flame and the inner-ring flame, referring to FIGS. 2 and 7, a gap 252 is defined between the outer ring flame spray 194 and the bottom cup cover 114. An opening 254 is defined in the flame spray 104 between the outer ring flame spray 194 and the inner ring flame spray 196, and the gap 252 and the opening 254 forms a secondary air supplement channel 256 together. In the present embodiment, the opening 254 is the space between two adjacent connecting ribs 200.

A part of the secondary air may enter flame feet of the middle-ring flame hole and the inner-ring flame hole 208 through the secondary air supplement channel 256, and the other part of the secondary air is provided to the flame feet of the middle-ring flame hole and the inner-ring flame hole 208 directly from the external. Furthermore, the secondary air supplement channel of the outer ring flame is provided to a flame foot of the outer-ring flame hole 224 directly from the external.

Referring to FIGS. 7 and 9, when in operation, the gas enters the first gas intake channel 134 through the gas inlet 140 of the first gas intake channel 134, and a part of the gas is sprayed to the first primary air supplement chamber 172 through the first nozzle 110. The part of the fuel gas sprayed out of the first nozzle 110 and the primary air entering the first primary air supplement chamber 172 through the first primary air supplement channel 246 enter the horizontal Venturi tube 174 together to form an outer ring gas mixture. The outer ring gas mixture arrives in the primary air/gas mixing and distributing chamber 180 (outer ring primary air/gas mixing and distributing chamber), and then enters the outer ring flame spray 194 and arrives at the outer mixed gas arrival chamber 214 of through the bottom cup cover opening 218 and the outer-ring opening 216, and finally is sprayed out through the outer-ring flame holes 224 to form the outer ring flame and sprayed out through the middle-ring flame holes to form the middle ring flame.

Referring to FIG. 8, the other part of the gas is diverted to the second gas intake channel 136 through the connecting channel 138, and arrives in the second nozzle 112. Said other part of the gas sprayed out of the second nozzle 112 and the primary air entering the second primary air supplement cavity 156 (inner ring primary air supplement cavity) through the second primary air supplement channel 248 (inner ring primary air supplement channel) enter the vertical Venturi tube 198 together for mixing. After mixing, an inner ring gas mixture arrives in the inner mixed gas arrival chamber 202, enters the inner ring flame spray 196, and finally is sprayed out though the inner-ring flame holes 208 to form the inner-ring flame.

In the present embodiment, the burner 100 illustrated only has one gas source for gas supply, as illustrated in FIG. 11, only the gas inlet 140 of the first gas intake channel 134 is connected to the gas source, the gas inlet of the second gas intake channel 136 (the second auxiliary hole 150) is closed by the second plug 152 while the first auxiliary hole 146 is closed by the first plug 148. As mentioned above, the gas supplied by the gas source enters the gas inlet 140 of the first gas intake channel 134, then a part thereof enters the first nozzle 110 to supply gas to the out ring and/or the middle ring, and the other part thereof enters the second gas intake channel 136 along the connecting channel 138, so as to supply gas to the inner ring through communication between the second gas intake channel 136 and the second nozzle 112, such that one gas source can supply gas to a multi-ring burner 100.

When fire power of one of the rings of flame is required to be controlled separately, for example, while keeping an outer ring fire power constant, an inner ring fire power is required to be adjusted separately. In which case a second gas source is required to be separately supplied to the inner ring flame spray 196, the connecting channel 138 (a transverse gas intake channel) is not processed, just the second plug 152 is removed and the second gas source is in communication with the gas inlet of the second gas intake channel 136.

Therefore, the burner 100 above not only can be adapted to a gas supply with a single gas source, but also can be adapted to a gas supply with two gas sources so as to meet use requirements of different consumers, and improve the universalization and standardization degree of the product.

Figure 12:
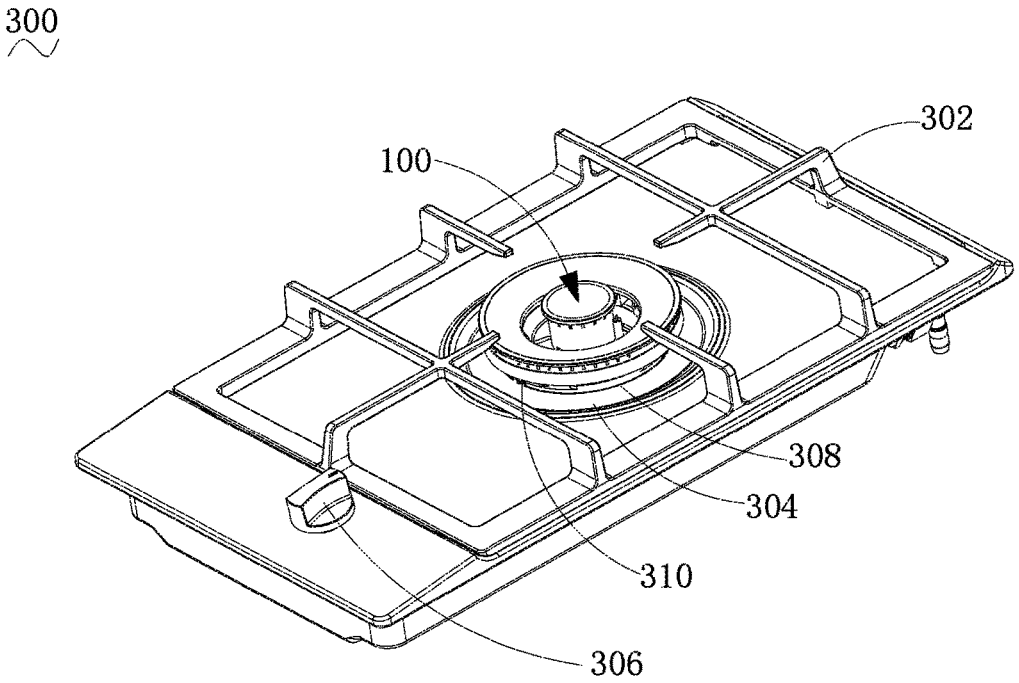
FIG. 12 illustrates a perspective view of a gas appliance according to a preferred embodiment of the present disclosure.
Figure 13:
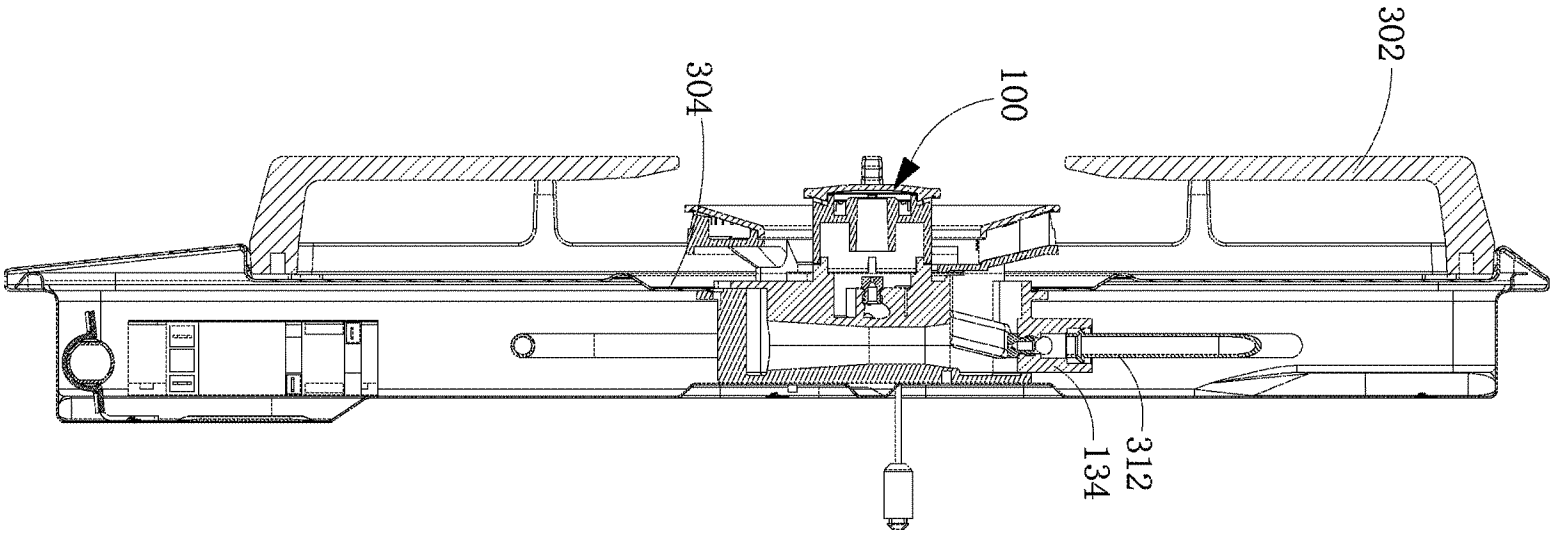
FIG. 13 illustrates a sectional view of a gas appliance according to a preferred embodiment of the present disclosure.

Please referring to FIGS. 12 and 13, the gas appliance 300 according to preferred embodiments of the present disclosure includes a burner 100 of the above embodiments, a pot support 302, a stove panel 304 and a rotary switch 306. In the present embodiment, the gas appliance 300 is a gas stove.

The pot support 302 is arranged on the stove panel 304. A through hole 308 and a second mounting hole 310 are defined in the stove panel 304, and the burner 100 passes through the through hole 308. The first mounting hole of the burner 100 is aligned with the second mounting hole 310, by passing a fastener, such as a screw, through the second mounting hole 310 and the first mounting hole, the burner 100 can be fixed in the through hole 308. The first gas intake channel 134 is connected to a gas intake tube 312 of the gas appliance.

The rotary switch 306 is arranged on the stove panel 304, and configured to control ignition, shut-off and fuel gas flow rate.

Since the burner 100 according to the above embodiments is employed in the gas appliance 300 above, the gas appliance 300 not only can be adapted to a gas supply with a single gas source, but also can be adapted to a gas supply with two gas sources so as to meet use requirements of different consumers, and improve the universalization and standardization degree of the product.

It should be understood that, in other embodiments, the gas appliance may be a large oven or other gas appliances, and the large oven includes the burner 100 according to the above embodiments.

Reference throughout this specification to "an embodiment," "some embodiments," "an illustrative embodiment" "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and illustrated, it shall be understood by those skilled in the art that various changes, modifications, alternatives and variants without departing from the principle of the present disclosure are acceptable. The scope of the present disclosure is defined by the claims or the like.

What is claimed is:

1. A bottom cup cover used in a burner, comprising:

a gas intake assembly provided with a first gas intake channel, a connecting channel and a second gas intake channel, the connecting channel connecting the first gas intake channel to the second gas intake channel, the second gas intake channel being obliquely arranged relative to the first gas intake channel, and the first gas intake channel having a gas inlet;

a first primary air supplement cavity and a second primary air supplement cavity being defined in the bottom cup cover, the first primary air supplement cavity being separated from the second primary air supplement cavity, the first gas intake channel being in communication with the first primary air supplement cavity, the second gas intake channel being in communication with the second primary air supplement cavity, and the connecting channel being configured to gas flow to circulate between the first primary air supplement cavity and the second primary air supplement cavity;

a first supplement part, a first mixing part and a second supplement part;

the gas intake assembly comprising a first gas intake part, a second gas intake part and a connecting part, the connecting part connecting the first gas intake part and the second gas intake part;

the first gas intake part, the first supplement part and the first mixing part being connected sequentially, the second supplement part being connected to the first mixing part from above, the second gas intake part penetrating the first supplement part and the second supplement part, and the connecting part being arranged at an outer side wall of the first supplement part; and the first supplement part defining the first primary air supplement cavity, the second supplement part defining the second primary air supplement cavity, the first mixing part defining a first groove in communication with the first primary air supplement cavity, the first gas intake part defining the first gas intake channel, the second gas intake part defining the second gas intake channel, and the connecting part defining the connecting channel.

2. The bottom cup cover according to claim 1, further comprising:

a rib arranged at a circumferential edge of the second primary air supplement cavity, and the rib is provided with a waterproof chamfer.

3. The bottom cup cover according to claim 2, further comprising:

a first surface and a first positioning member arranged on the first surface, wherein the first positioning member is connected to an outer circumferential edge of the rib.

4. The bottom cup cover according to claim 3, wherein the first positioning member comprises a plurality of stepped structures arranged on the first surface, the plurality of stepped structures are connected to the outer circumferential edge of the rib in a spaced arrangement, each stepped structure comprises a first top surface and a second top surface, and the first top surface is more adjacent to the second primary air supplement cavity than the second top surface.

5. A burner, comprising:

a bottom cup assembly; and a flame spray arranged on the bottom cup assembly, wherein the bottom cup assembly comprises a bottom cup cover and a bottom cup seat, the bottom cup cover is fitted in the bottom cup seat, and the flame spray is arranged on the bottom cup cover, wherein the bottom cup cover further comprises:

a gas intake assembly provided with a first gas intake channel, a connecting channel and a second gas intake channel, the connecting channel connecting the first gas intake channel to the second gas intake channel, the second gas intake channel being obliquely arranged relative to the first gas intake channel, and the first gas intake channel having a gas inlet;

a first primary air supplement cavity and a second primary air supplement cavity being defined in the bottom cup cover, the first primary air supplement cavity being separated from the second primary air supplement cavity, the first gas intake channel being in communication with the first primary air supplement cavity, the second gas intake channel being in communication with the second primary air supplement cavity, and the connecting channel being configured to gas flow to circulate between the first primary air supplement cavity and the second primary air supplement cavity;

a first supplement part, a first mixing part and a second supplement part;

the gas intake assembly comprises a first gas intake part, a second gas intake part and a connecting part, the connecting part connects the first gas intake part and the second gas intake part;

the first gas intake part, the first supplement part and the first mixing part are connected sequentially, the second supplement part is connected to the first mixing part from above, the second gas intake part penetrates the first supplement part and the second supplement part, and the connecting part is arranged to an outer side wall of the first supplement part; and the first supplement defines a first primary air supplement cavity, the second supplement part defines a second primary air supplement cavity, the first mixing part defines a first groove in communication with the first primary air supplement cavity, the gas intake part defines the first gas intake channel, the second gas intake part defines the second gas intake channel, and the connecting part defines the connecting channel.

6. The burner according to claim 5, wherein the bottom cup seat further comprises:

a first chamber part, a second mixing part and a second chamber part connected sequentially, the first chamber part is connected to the first supplement part and defines a first chamber, the first chamber and the first primary air supplement cavity form a first primary air supplement chamber together;

the second mixing part is connected to the first mixing part, the second mixing part and the first mixing part form a horizontal Venturi tube together, the second mixing part defines a second groove, and the second groove and the first groove form a mixing channel of the horizontal Venturi tube together;

the second chamber part defines a primary air/gas mixing and distributing chamber, and the primary air/gas mixing and distributing chamber is in communication with the first primary air supplement chamber through the mixing channel.

7. The burner according to claim 6, further comprising:

an inner flame cover and an outer flame cover, the flame spray further comprising an outer ring flame spray, an inner ring flame spray and a vertical Venturi tube;

the inner ring flame spray being located inside the outer ring flame spray, the vertical Venturi tube being located inside the inner ring flame spray, the inner flame cover covering the inner ring flame spray, the inner flame cover, the inner ring flame spray and the vertical Venturi tube defining an inner mixed gas arrival chamber together, and the vertical Venturi tube communicating the inner mixed gas arrival chamber with the second primary air supplement cavity; and the outer flame cover covers the outer ring flame spray, the outer flame cover and the outer ring flame spray defining an outer mixed gas arrival chamber together, and the outer mixed gas arrival chamber being in communication with the primary air/gas mixing and distributing chamber.

8. A gas appliance, comprising: a burner, the burner further comprising:

a bottom cup assembly; and a flame spray arranged on the bottom cup assembly, wherein the bottom cup assembly comprises a bottom cup cover and a bottom cup seat, the bottom cup cover is fitted in the bottom cup seat, and the flame spray is arranged on the bottom cup cover, wherein the bottom cup cover further comprises:

a gas intake assembly provided with a first gas intake channel, a connecting channel and a second gas intake channel, the connecting channel connecting the first gas intake channel to the second gas intake channel, the second gas intake channel being obliquely arranged relative to the first gas intake channel, and the first gas intake channel having a gas inlet;

a first primary air supplement cavity and a second primary air supplement cavity being defined in the bottom cup cover, the first primary air supplement cavity being separated from the second primary air supplement cavity, the first gas intake channel being in communication with the first primary air supplement cavity, the second gas intake channel being in communication with the second primary air supplement cavity, and the connecting channel being configured to gas flow to circulate between the first primary air supplement cavity and the second primary air supplement cavity;

a first supplement part, a first mixing part and a second supplement part, the gas intake assembly comprises a first gas intake part, a second gas intake part and a connecting part, the connecting part connects the first gas intake part and the second gas intake part;

the first gas intake part, the first supplement part and the first mixing part are connected sequentially, the second supplement part is connected to the first mixing part from above, the second gas intake part penetrates the first supplement part and the second supplement part, and the connecting part is arranged to an outer side wall of the first supplement part; and the first supplement defines a first primary air supplement cavity, the second supplement part defines a second primary air supplement cavity, the first mixing part defines a first groove in communication with the first primary air supplement cavity, the gas intake part defines the first gas intake channel, the second gas intake part defines the second gas intake channel, and the connecting part defines the connecting channel.

9. The gas appliance according to claim 8, wherein the bottom cup seat further comprises:

a first chamber part, a second mixing part and a second chamber part connected sequentially, the first chamber part is connected to the first supplement part and defines a first chamber, the first chamber and the first primary air supplement cavity form a first primary air supplement chamber together;

the second mixing part is connected to the first mixing part, the second mixing part and the first mixing part form a horizontal Venturi tube together, the second mixing part defines a second groove, and the second groove and the first groove form a mixing channel of the horizontal Venturi tube together;

the second chamber part defines a primary air/gas mixing and distributing chamber, and the primary air/gas mixing and distributing chamber is in communication with the first primary air supplement chamber through the mixing channel.

10. The gas appliance according to claim 9, wherein the burner further comprises:

an inner flame cover and an outer flame cover, the flame spray further comprising an outer ring flame spray, an inner ring flame spray and a vertical Venturi tube;

the inner ring flame spray being located inside the outer ring flame spray, the vertical Venturi tube being located inside the inner ring flame spray, the inner flame cover covering the inner ring flame spray, the inner flame cover, the inner ring flame spray and the vertical Venturi tube defining an inner mixed gas arrival chamber together, and the vertical Venturi tube communicating the inner mixed gas arrival chamber with the second primary air supplement cavity; and the outer flame cover covers the outer ring flame spray, the outer flame cover and the outer ring flame spray defining an outer mixed gas arrival chamber together, and the outer mixed gas arrival chamber being in communication with the primary air/gas mixing and distributing chamber.

* * * * *